US006338664B1

(12) United States Patent
Wong

(10) Patent No.: US 6,338,664 B1
(45) Date of Patent: Jan. 15, 2002

(54) TOY VEHICLE HAVING CENTER STEERING CIRCUIT AND REMOTE CONTROLLER WITH TOGGLE FUNCTION

(75) Inventor: Yau Wah Wong, New Territories (HK)

(73) Assignee: New Bright Industrial Co., Ltd., Kowloon (HK)

( * ) Notice: Subject to any disclaimer, the term of this patent is extended or adjusted under 35 U.S.C. 154(b) by 0 days.

(21) Appl. No.: 09/592,859

(22) Filed: Jun. 12, 2000

(51) Int. Cl.[7] ..... A63H 17/39

(52) U.S. Cl. ..... 446/468; 446/456; 446/460; 446/462

(58) Field of Search ..... 446/456, 460, 446/462, 465, 468

(56) References Cited

U.S. PATENT DOCUMENTS

| | | | | |
|---|---|---|---|---|
| 3,454,927 | A | | 7/1969 | Dame et al. |
| 3,639,755 | A | | 2/1972 | Wrege |
| 3,705,387 | A | * | 12/1972 | Stern et al. |
| 3,742,507 | A | | 6/1973 | Pirre |
| RE29,525 | E | | 1/1978 | Willmott |
| 4,080,602 | A | | 3/1978 | Hattori et al. |
| 4,166,338 | A | | 9/1979 | Asano |
| 4,206,411 | A | | 6/1980 | Meyer |
| 4,424,470 | A | | 1/1984 | Finch |
| 5,088,955 | A | * | 2/1992 | Ishimoto |
| 5,696,513 | A | | 12/1997 | Song |
| 5,854,594 | A | | 12/1998 | Lin et al. |
| 6,241,574 | B1 | * | 6/2001 | Helbing ..... 446/454 |

* cited by examiner

*Primary Examiner*—John A. Ricci
(74) *Attorney, Agent, or Firm*—Nixon & Vanderhye P.C.

(57) ABSTRACT

A remote controller for a toy vehicle includes a toggle switch on a hand controller for selectively enabling one of two sets of vehicle functions, and a reduced signal set integrated circuit for transmitting control signals to the vehicles. A group of function keys on the hand controller activates a function from each function set. The combined settings of the toggle switch and function key cause a unique combination of toggle switch signal and function key signal to be transmitted to the vehicle. The vehicle decodes the toggle switch and function key signal to determine which control function is to be performed. In addition, the vehicle may have a center steering controller which automatically sets a center steering course for the vehicle when no turn signal is being received.

1 Claim, 3 Drawing Sheets

| IC receives signal in Receiver | Output pin of IC activates | | | Steering Position |
|---|---|---|---|---|
| | L | R | C | |
| Left signal | High | Low | Low | Left |
| Right signal | Low | High | Low | Right |
| No left and right signal | Low | Low | High | Central |

FIG. 2
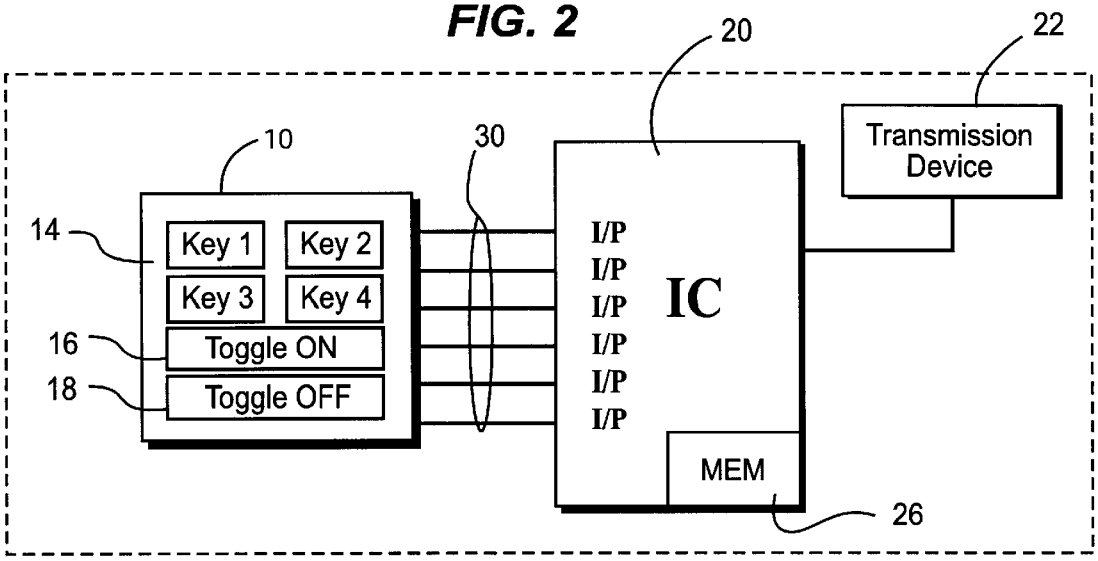
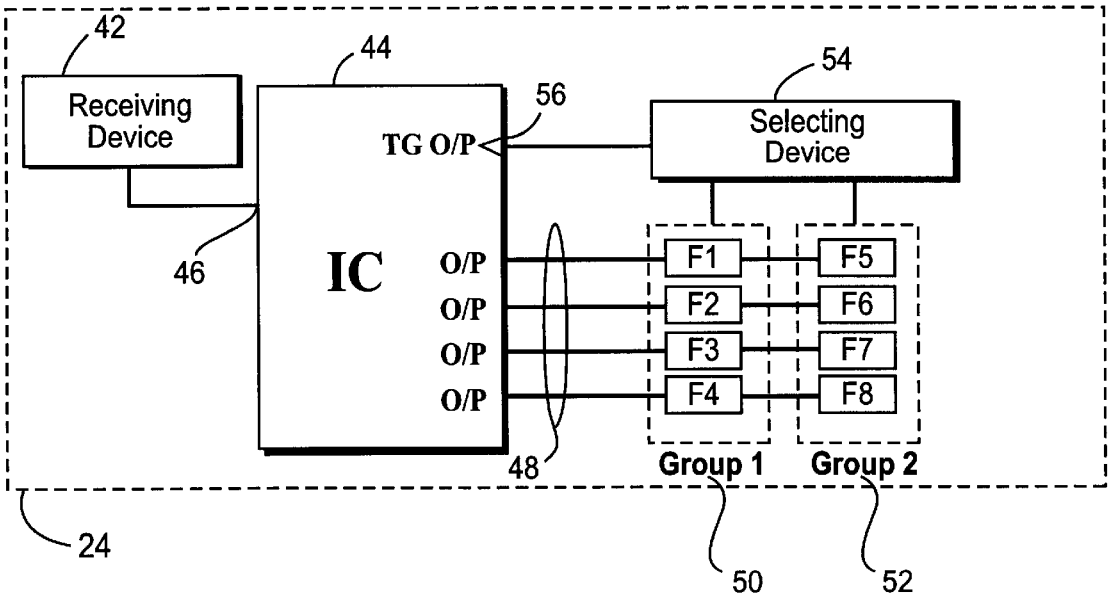
FIG. 4

| IC receives signal in Receiver | Output pin of IC activates | | | Steering Position |
|---|---|---|---|---|
| | L | R | C | |
| Left signal | High | Low | Low | Left |
| Right signal | Low | High | Low | Right |
| No left and right signal | Low | Low | High | Central |

TOY VEHICLE HAVING CENTER STEERING CIRCUIT AND REMOTE CONTROLLER WITH TOGGLE FUNCTION

FIELD OF TIE INVENTION

The field of the invention relates to the field of remote controlled vehicles and, in particular, to steering mechanisms and remote controllers for toy vehicles and other small motorized devices.

BACKGROUND AND SUMMARY OF THE INVENTION

There is a long-felt need for electronic control circuits for remote controlled toy vehicles having the capability to control numerous vehicle functions and that are inexpensive to fabricate. Remote control circuits are housed in a hand controller having function keys that enable an individual to control a vehicle. In response to a function key selection, the circuits transmit control signals from the hand controller to control the operation of the vehicle. The number of vehicle functions to be remotely controlled continues to increase as the number of vehicle functions, e.g., steering, direction, speed, lights, sound, etc., increases with newer toys. As the number of functions increase, the control circuits for remotely controlled toy vehicles have become complex and more expensive. The cost of control circuits is often a substantial portion of the entire manufacturing cost of the vehicle. The market for toy vehicles is notoriously competitive and price sensitive. It is economically impracticable to substantially increase the sales price for remote controlled toys to pay for expensive control electronics. Accordingly, a significant cost and market advantage can be gained by reducing the cost of the control electronics in a remote controlled toy vehicle. The present invention provides a low cost integrated circuit (IC) controller for remote control vehicles.

The present invention includes a IC remote control circuit for a hand controller that includes a toggle switch for reducing the number of function keys, control lines, memory and transmitted signals needed to control a vehicle. The hand controller has a small group of function keys, e.g., four keys labeled k1, k2, k3 and k4. These function keys are used to control all remotely controllable functions of the vehicle. The vehicle may have more controllable functions, such as eight controllable functions, than the number of function keys, such as four function keys, on the hand controller. To handle a large number of controllable functions, each of the function keys alternatively controls two (or more) functions of the vehicle. A toggle switch on the hand controller configures the function keys to alternatively control different vehicle functions. In particular, the toggle switch(es) on the hand controller determines which of two (or more) vehicle functions that will be controlled by each function key.

The toggle switch determines whether the small group of function keys on the hand controller performs a first set of functions (function nos. 1 to 4), or a second set of functions (function nos. 5 to 8). These key function groups may include, for example, a first set of four functions for left and right steering of the vehicle, and forward and reverse directions; and a second set of four functions which include a slow vehicle speed, fast speed, on/off lights and on/off horn. Where the hand controller has four function keys and one toggle function, the controller will emit five signals—four signals each corresponding to one of the four function keys and a fifth (and possible a sixth) signal for the toggle key. While the actual number of function keys will depend on the total number of controllable vehicle functions, it is preferable that the number of functions keys be fewer than the number of functions and that the number of functions be an integer multiple of the number of function keys.

The receiving controller on the vehicle includes an antenna to receive the control signals transmitted by the hand controller over a wireless or wired link to the vehicle. The receiving controller in the vehicle processes the signals received from the hand controller and converts the signals into vehicle control signals that operate and control the vehicle. The signals transmitted by the hand controller include a unique control signal for each function key, and for the toggle switch(es). The receiving controller detects each of the signals and recognizes them as a specific function key signal or a toggle switch(es) signal.

The receiving controller receives and decodes the toggle switch signal and the function key signals. When received by the vehicle controller, the toggle switch signal is applied to control a function group selection circuit in the vehicle. The function group selection circuit controls which one of two groups of vehicle control functions are active at any given period of time. Accordingly, the toggle switch signal causes to be active either a first group of vehicle control functions or a second group of vehicle control functions, depending on the toggle switch setting on the hand controller. The first group of vehicle control functions may be vehicle left and right steering and vehicle forward and reverse drive directions. The second group of vehicle control functions may be up and down bucket movement, and up and down backhoe movement. Thus, depending on the setting of the toggle switch (and, hence, the toggle switch signal) the active functions being controlled on the vehicle may be steering (left, right, forward and backward) or movements of bucket and backhoe.

The function key signals received by the vehicle correspond to each of the function keys on the hand controllers. Each function key signal may be applied in the vehicle to activate one of two functions, wherein one function is in the first group of vehicle control functions and the second function is in the second group of vehicle control functions. However, two vehicle functions are not activated simultaneously when a function key control signal is received. Rather, one vehicle function is activated which corresponds to both the function key signal and the group of control functions selected by the received toggle switch signal.

Accordingly, the toggle switch enables a hand controller with only four function keys to control eight vehicle functions. Several advantages flow from using the toggle switch to alternatively configure the function keys to activate different vehicle functions. These advantages for a hand controller having four function keys and a toggle switch include: (i) that the controller IC need have only five or six input ports (pins) (four for the function keys, and one or two for the toggle switch(es)), rather than eight ports that would otherwise be needed for eight functions; (ii) the hand controller need have only four function keys, rather than eight; (iii) only five or six control signals need be stored in the IC for each of the function keys and toggle switch(es), and (iv) the memory needed in the IC for generating the control signals is minimized because of the reduced number of control signals. These advantages allow for the use of a less expensive controller IC provide cost savings in manufacture of a remote control toy vehicle. Similar advantages are gained because the controller IC for the vehicle also need only have five or six input ports and only five output ports.

A further aspect of the present invention is a center steering controller formed as an integrated circuit (IC) in the vehicle that controls the steering gear box of a remote controlled toy vehicle. The center steering controller includes an IC processor that generates left and right turn output signals by activating left and right turn signal lines between the controller and an electrically-operated steering gear box for the toy vehicle. The IC also automatically generates a center steering command when no left or right turn signals are being received by the vehicle. The IC processor is controlled by left and right turn signals received from a radio (RF) receiver, and by a center detector circuit. A mechanical center steering controller is disclosed in commonly-assigned U.S. Pat. No. 6,170,354 and incorporated by reference here.

The central detector circuit monitors the left and right signal control lines between the integrated circuit and steering gear box. The central detector remains inactive if either signal line is active for left and right turning. If no signal is present on the left and right signal lines, the central detector generates a signal to the processor to cause the gear box to center the steering wheels and drive the vehicle in a straight (or near center) direction. The operator sets the central detector to steer the vehicle in a straight direction, or to steer the vehicle slightly to the left or right (such as if the user wants the vehicle to turn in a large radius circle when no turn signal is being received). An advantage of the automatic central steering control circuit is its simplicity in requiring only left and right turn signals to output left and right signals to the gear box. A center position signal is automatically generated by the central detector and processor when there is no right or left turn signal. Another advantage is that the automatic central steering control circuit has minimal components and, thus, has a manufacturing cost advantage.

BRIEF DESCRIPTION OF THE DRAWINGS

These, as well as other objects and advantages of this invention, will be more completely understood and appreciated by careful study of the following more detailed description of a presently preferred exemplary embodiment of the invention taken in conjunction with the accompanying drawings, of which:

FIG. 2 is a schematic diagram of the control electronics in the hand controller shown in FIG. 1;

FIG. 4 is a schematic diagram of the control electronics in a remote control vehicle shown in FIG. 1;

DETAILED DESCRIPTION OF THE DRAWINGS

Figure 1:
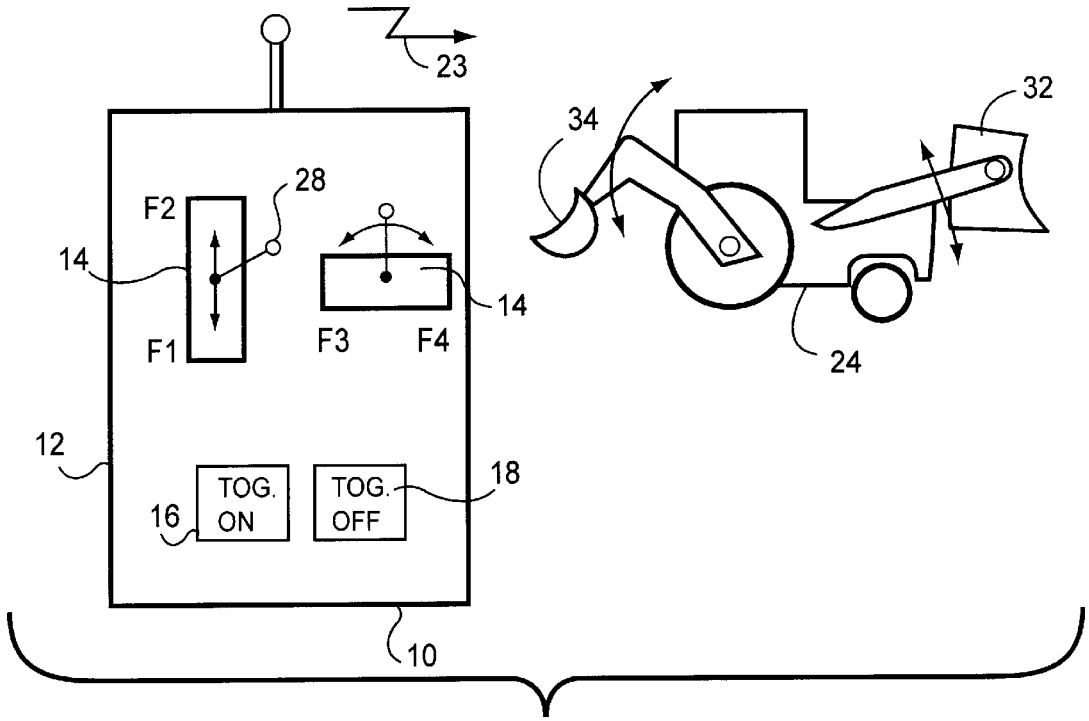
FIG. 1 is an illustration showing an exemplary remote control vehicle and hand controller.

FIGS. 1 and 2 show schematically a remote hand controller unit 10 having a casing 12. On a front face of the casing are function keys 14, a toggle ON key 16 and a toggle OFF key 18. In an alternative embodiment, the toggle switches may be a single switch. The hand controller internally includes an integrated circuit (IC) 20 which is electrically linked to the function and toggle keys, and to a transmission device 22. The transmission device generates wireless, e.g., radio frequency (RF), signals 23 that are transmitted from the hand controller to a toy vehicle 24. The transmission device 22 is controlled by the controller IC processor.

The integrated circuit (IC) in the hand controller 20 may be, for example, a 4 or 8 bit microcontroller. This microcontroller may be a general purpose IC device or may be an ASIC (application specific integrated circuit) specially designed for a hand-held remote control device. The integrated circuit has an arithmetic logic processing unit and on chip memory 26, such as random access memory (RAM) and static read-only memory (ROM). The ROM may include a look-up table that identifies for each function key and toggle key a unique control signal to be modulated with an RF carrier wave generated by the transmission device 22. The modulated carrier signal 23 is transmitted to a vehicle receiver that separates the control signals from the carrier wave. The transmitted control signals 23 are each a unique to a function key or a toggle switch on the hand controller. The control signals are received by the vehicle 24 and converted to digital function key and toggle switch control signals for a vehicle IC processor.

The function keys 14 (key 1, key 2, key 3 and key 4) of the hand controller 10 are depressed to select a function of the remotely controlled toy vehicle 24 that corresponds to the depressed key and the activated toggle key 16, 18. For example, keys 1 and 2 may be selected to control left and right turns of the vehicle. These pair of keys (k1, k2) may be operated by a single joy stick switch 28 on the hand controller that the user operates by pushing the joys tick to the left or right to control the left and right steering of the vehicle. Similarly, function key 3 and key 4 may select forward and reverse driving directions of the vehicle 24. These keys (k3, k4) may also be operated through a single joy stick switch that is pushed forward for forward vehicle direction movement and pushed rearward of the hand controller for reverse vehicle movement. Each function key activates an input line (I/P) 30 of the IC 20 in the hand controller, and the IC detects a depressed function key by sensing an active input line 30.

The toggle ON and toggle OFF keys 16, 18 of the hand controller are also directly linked to respective input pins (I/P) 30 of the IC in the hand controller. Toggle ON and toggle OFF keys change the set of vehicle functions controlled by each of the function keys k1 through k4. For example, if the toggle switch ON 16 is depressed, the function keys 1 through 4 control a set of functions, such as left or right turns, and forward and backward movement of the vehicle. If the toggle switch OFF 18 is depressed, the function keys 1 through 4 cause a different set of functions to be performed by a vehicle, such as control of a bucket 32 and backhoe 34 on a toy tractor. For example, when the toggle OFF switch is active, function keys 1 and 2 may control the up and down movement of a front end bucket 32 on a toy tractor 24, and function keys 3 and 4 may control the up and down movements of a backhoe arm 34 on the tractor. The movements of a front end bucket and backhoe are exemplary set of functions that can be controlled with the function keys of the hand controller when the toggle OFF button is active. A wide variety of other vehicle functions may be controlled by the hand controller. These various function sets will depend on each type of remote controlled vehicle to which the invention is applied and is subject to the design considerations of each vehicle type and model, and to the type of circuit program written on the IC.

The activation of the toggle ON or toggle-OFF keys 16, 18 cause an active high (or alternatively an active low) signal to be applied to a respective input port (I/P) 30 of the integrated circuit (IC) of the hand controller. When the IC 20 detects that an active high (or alternatively an active low) on an input pin corresponding to either the toggle ON or toggle ON key, the IC addresses its memory 26 to select the transmission signal corresponding to the toggle OFF or toggle-OFF key that has been activated. The memory includes a digital instruction defining a signal for the toggle switch setting to be transmitted to the vehicle.

Figure 3:
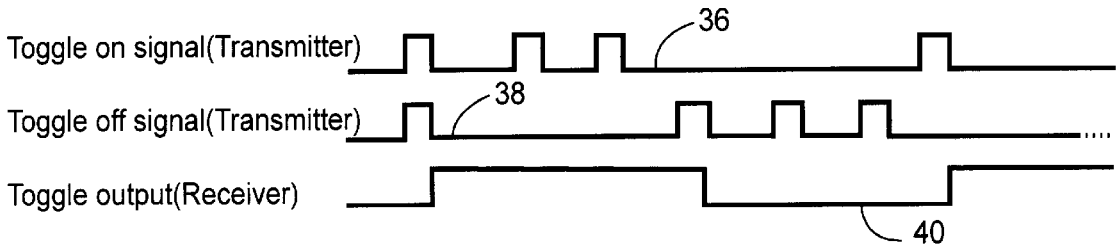
FIG. 3 shows waveforms of control signals generated by the hand controller and a toggle switch control signal generated within the vehicle.

FIG. 3 shows exemplary waveforms corresponding to a toggle ON or toggle OFF signal transmitted from the hand controller. These signals are determined based upon waveform instructions stored in memory of the IC. The waveform is applied to an RF carrier signal generated by the transmitter. The carrier signal may be at a frequency appropriate for remote control toys, such as a 27.145 MHz RF signal, especially for use in the United States. The toggle ON signal 36 may be a sequence of three ON-pulses, followed by an extended OFF period and terminated by a single ON-pulse. In contrast, the toggle OFF signal 38 may be a single ON pulse followed by an extended OFF period and then by a sequence of three ON-pulse. When these toggle signals are received, the vehicle converts them into a toggle output control signal 40 that is ON (e.g., high), when a toggle ON signal is being received, or OFF, when a toggle OFF signal is being received. The toggle output selected signal controls a selected function group drive in the vehicle.

FIG. 4 schematically shows a receiver 42 and integrated circuit controller 44 for the remote controlled vehicle 24. The receiver detects RF transmissions 23 from the hand controller 10. The receiver demodulates the control signals generated by the hand controller IC from the carrier wave applied by the transmission device 22. These control signals (see FIG. 3) are applied to an input port 46 to the IC 44 for the vehicle. The control signals may be various unique series of pulses (see FIG. 3), each of which series corresponds to one of the function keys, and the toggle ON or toggle OFF keys of the hand controller. The receiver IC 44 includes a signal detector processor which discriminates and identifies the various signals corresponding to each of the four function keys and the toggle ON and OFF switch. When the receiver IC detects a signal corresponding to one of the function keys, the IC will activate an output port (O/P) 48 corresponding to that function key. The IC has four output ports (O/P) 48 corresponding to each of the four functions keys 14 on the hand controller 10. These output lines become active (high) or active (low) depending on whether the associated function key 14 for the respective line is depressed by an operator of the hand-held controller.

Each of these four output ports 48 is connected to a respective pair of functions on the vehicle, wherein one function is in a first function set 50 and the second function is in the second function set 52. As shown in FIG. 4, functions 1, 2, 3 and 4 are grouped as function set I (50), and functions 5, 6, 7 and 8 are assigned to function set II (52). Each output port 48 of the receiver IC 44 activates a function from set I and a function from set II. However, both functions (one from set I and one from set II) are not simultaneously performed by the vehicle. For the vehicle to perform a function, such as F1 corresponding to a left turn, both the IC output 48 corresponding to function key 1 and the toggle output which activates set I (F1, F2, F3 and F4)(50) must have been selected by the selecting device 54 in the vehicle. The function set selecting device 54 in the vehicle 24 is coupled to a single output port (TG/OP) 56 of the IC. The selecting device activates alternatively set I or set II functions 50, 52 on the vehicle. The output of the IC to the selecting device is, in turn, controlled by the toggle ON, toggle OFF signals received by the vehicle.

The function sets I and II 50, 52 correspond to groups of function performed by the vehicle. For example, function set I may correspond to the steering and vehicle movement. In set I, key F1 may activate a left turn of the vehicle; key F2 may activate the right turn of the vehicle; key F3 may cause the vehicle to move forward, and key F4 may cause the vehicle to move in reverse. By way of contrast, the functions associated with set II (F5, F6, F7 and F8) may correspond to vehicle functions (e.g., bucket/backhoe action) different than steering and vehicle direction.

For example, set II may correspond to movement of attachments to the vehicle, such as front-end loader and backhoe. The particular vehicle functions performed in each function set will depend upon the particular design of the vehicle to which the invention is applied and the type of circuit program written on the IC. For example, the set II functions may relate to flashing lights and sirens if the vehicle is a toy police car or fire engine. Similarly, the functions performed by set I may be functions unrelated to steering. For example, in a remote controlled airplane, the set I functions may increase power to the propeller (F1), decrease power applied to propeller (F2), left bank (F3), and right bank (F4). It is generally preferable that the functions in each of sets I and II be related functions, such as vehicle steering and movement direction for set I and lights and sirens for set II.

The sets of functions correspond to the functions activated by the function keys on the hand controller 10 when the toggle switch 16, 18 is either ON or OFF. For example, set I functions will always be selected in the disclosed embodiment when the toggle ON switch is activated. Similarly, set II functions will always be selected when the toggle OFF switch has been activated. Accordingly, the person operating the remote controlled vehicle 24 can control the steering direction and direction of movement of the vehicle with the four function keys 1 through 4, and not be distracted by additional function keys which would activate lights, backhoe, front end loader or other features of the vehicle.

Figures 5, 6:
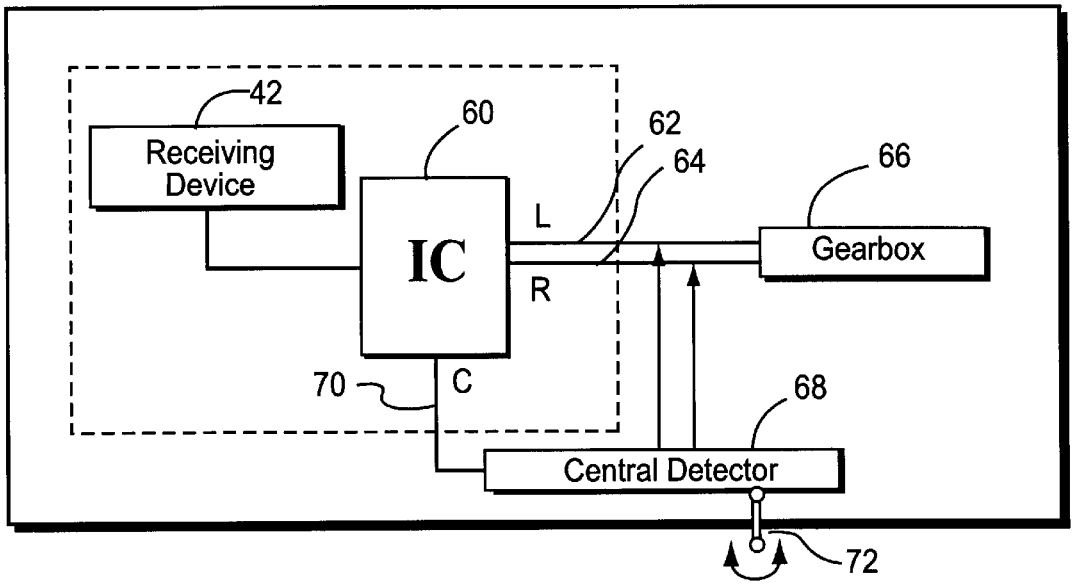
FIG. 5 is a schematic electronics diagram of an alternative steering control electronic circuit.
FIG. 6 is an exemplary signal chart for the alternative steering control circuit.

FIG. 5 shows an alternative embodiment for an IC controller 60 for a remote controlled vehicle 24 having a center steering control. The IC controller 60 may be similar to the IC controller 44 shown in FIG. 4 and connected in a similar way with set I and set II functions selected by a selecting device. However, for illustrative purposes only the effective connection for the left (L) and right (R) steering commands 62, 64, from the IC 60 to the vehicle's steering gear box 66 are shown. When the IC 60 activates the output pin 62 corresponding to a left turn signal (L), the gear box detects the control signal and causes the vehicle to make a left turn. Similarly, when the IC activates the output pin 64 corresponding to a right turn, the gear box 66 detects the output signal and causes the vehicle 24 to steer in a right turn direction.

The vehicle 24 is to drive in a center driving position, e.g., in a straight line direction, when no left or right turn signals are being applied to the gear box. A central detector 68 in the vehicle determines the center steering position. The central detector 68 may be a microcontroller capable of sensing the state of output lines 62, 64 and generating control signals to be applied to an input 70 of the IC 60, and include a manually settable switch 72 for central steering control. This central detector microcontroller may be configured as a separate series of functions executed by the IC processor 60.

FIG. 6 is a chart showing exemplary signals for the center steering controller. When there exists a left or right turn signal on output lines 62, 64, the central detector 68 generates a LOW center control signal (C) which does not activate a center steering command. If there is no left or right turn signal, the central detector generates a HIGH center control signal on input line 70. The HIGH center control signal causes the central detector and IC 60 to cause the vehicle to steer in a center driving position.

The central detector 68 may be set to cause the vehicle to drive in a straight-ahead forward direction as the center steering position. Alternatively, the switch 72 of the central detector may be set to cause the gear box to steer the vehicle in a shallow right or left turn as the central steering position. A slight left or right turn at the central steering position may be helpful to ensure that the vehicle does not inadvertently drive straight out of RF transmission range of the hand-held remote controller. The central detector 68 causes the gear box 66 to impart a slight left or right turn by applying appropriate signals to the left and right turn signals 62, 64, to the gear box. These signal inputs may be intermittently applied to either left or right inputs to the gear box so as to cause the gear box to turn the vehicle slightly to the left or right. Alternatively, the central detector may apply no left or right turn signals to the gear box if the central steering position is to be straight ahead direction of the vehicle.

The central detector will apply left or right turn signals to the gear box corresponding to the manual setting for the center steering position. The central detector will apply the center steering signals to the gear box upon being signaled by the IC for the vehicle. Accordingly, the central detector is automatically activated by the IC and does not require special signaling from the hand controller or from the operator.

The invention has been described in connection with what is presently considered to be the preferred embodiment. The invention is not limited to the disclosed embodiment. The invention covers various modifications and equivalent arrangements included within the spirit and scope of the appended claims.

What is claimed is:

1. A steering controller for a remote controlled toy vehicle comprising:

a receiver to receive steering left and right turn control signals from a remote control device;

an integrated circuit electrically coupled to the receiver to detect when a left turn signals is being received and when a right turn control signal is being received, said integrated circuit having a left turn output pin, a right turn output pin, and a center steering output pin, said left turn output pin being activated by the integrated circuit when a left turn signal is being detected, said right turn output pin being activated when said right turn control signal is being detected, and said center steering output pin is activated in an absence of a left turn signal and a right turn signal;

a center steering controller electrically connected to the center steering output pin, and said center steering controller having left turn and right turn output signals which are simultaneously deactivated when the center steering output pin is active;

a steering gear box having a left turn input signal port electrically coupled to the left turn output pin of the integrated circuit and to the left turn output signal of the center steering controller, and a right turn input signal port electrically coupled to the right turn output pin of the integrated circuit and to the right turn output signal of the center steering controller, wherein said gear box turns the vehicle in a left turn in response to an active left turn output pin of the integrated circuit, turns the vehicle in a right turn in response to an active right turn output pin of the integrated circuit, and steers the vehicle in a center direction in response to an absence of left turn and right turn output signals from the center steering controller.

* * * * *